US009719737B2

(12) United States Patent
Kalbacher et al.

(10) Patent No.: US 9,719,737 B2
(45) Date of Patent: Aug. 1, 2017

(54) HEAT EXCHANGER AND PRODUCTION METHOD

(71) Applicants: Modine Manufacturing Company, Racine, WI (US); Mann+Hummel GmbH, Ludwigsburg (DE)

(72) Inventors: Klaus Kalbacher, Rangendingen (DE); Rebecca Frey, Esslingen (DE); Gerrit-Tobias Speidel, Ludwigsburg (DE); Alexander Korn, Güglingen (DE); Heinz Bühl, Erlenbach (DE); Karl-Ernst Hummel, Bietigheim-Bissingen (DE); Ulrich Dehnen, Kornwestheim (DE)

(73) Assignees: Modine Manufacturing Company, Racine, WI (US); Mann+Hummel GmbH, Ludwigsburg (DE)

( * ) Notice: Subject to any disclaimer, the term of this patent is extended or adjusted under 35 U.S.C. 154(b) by 126 days.

(21) Appl. No.: 14/243,038

(22) Filed: Apr. 2, 2014

(65) Prior Publication Data

US 2014/0299295 A1 Oct. 9, 2014

(30) Foreign Application Priority Data

Apr. 4, 2013 (DE) ..... 10 2013 005 796

(51) Int. Cl.
*F28D 7/00* (2006.01)
*F28D 7/10* (2006.01)
(Continued)

(52) U.S. Cl.
CPC ..... *F28F 9/26* (2013.01); *F28D 9/0043* (2013.01); *F28F 9/001* (2013.01); *F28F 9/0253* (2013.01);
(Continued)

(58) Field of Classification Search
CPC ..... F28F 9/02; F28F 9/00; F28F 9/001; F28F 9/002; F28F 9/005; F28F 9/007;
(Continued)

(56) References Cited

U.S. PATENT DOCUMENTS 3,263,747 A 8/1966 McKay
5,477,919 A * 12/1995 Karube ..... F28D 1/05391 165/176
(Continued)

FOREIGN PATENT DOCUMENTS

DE 102006005106 A1 8/2007
DE 102009039569 A1 3/2011
FR WO 2012059152 A1 * 5/2012 ..... F28F 9/0253

OTHER PUBLICATIONS

U.S. Appl. No. 14/243,031 Office Action from the US Patent and Trademark Office dated Jan. 14, 2016 (18 pages).
(Continued)

*Primary Examiner* — Frantz Jules
*Assistant Examiner* — Steve Tanenbaum
(74) *Attorney, Agent, or Firm* — Michael Best & Friedrich LLP

(57) ABSTRACT

A stub connection for a heat exchanger that is arranged in a housing and has a stack including plates and fins. The housing consists of housing parts which can be joined together, and at least one first stub for a first heat-exchanging medium being integrated directly into the housing. The stub connection also includes at least one second stub for a second heat-exchanging medium that extends to outside the housing. The at least one second stub is configured for the connection of a line and is integrated directly or indirectly into the housing.

15 Claims, 3 Drawing Sheets

(51) Int. Cl.

| | |
|---|---|
| ***F28D 9/02*** | (2006.01) |
| ***F28D 9/00*** | (2006.01) |
| ***F28F 9/26*** | (2006.01) |
| ***F28F 9/00*** | (2006.01) |
| ***F28F 9/02*** | (2006.01) |
| ***F28F 21/06*** | (2006.01) |
| *F28D 21/00* | (2006.01) |

(52) U.S. Cl.
CPC .... *F28F 21/067* (2013.01); *F28D 2021/0082* (2013.01)

(58) Field of Classification Search
CPC .. F28F 9/0075; F28F 2225/02; F28F 2280/06; F28F 2275/14; F28F 9/0246; F28F 9/0248; F28F 9/0251; F28F 9/0253; F28F 9/0256; F28F 9/04; F28F 9/26; F28F 21/067; F01P 11/10; F24F 13/20; F24F 2013/202; F28D 9/0031; F28D 9/0043; F28D 9/0056; F28D 2021/0082; F16L 39/00; F16L 41/086; F16L 21/035; F16L 9/04; F16L 2280/06
USPC ..... 165/162, 157–160
See application file for complete search history.

(56) References Cited

U.S. PATENT DOCUMENTS

| | | | | |
|---|---|---|---|---|
| 6,908,117 | B1 * | 6/2005 | Pickett, Jr. ..... | F16L 41/086 285/137.11 |
| 2005/0023827 | A1 | 2/2005 | Walterscheid et al. | |
| 2005/0156388 | A1 * | 7/2005 | Takano ..... | F16L 21/035 277/628 |
| 2006/0278377 | A1 * | 12/2006 | Martins ..... | F02B 29/0412 165/140 |
| 2008/0264621 | A1 * | 10/2008 | Yoshino ..... | B23P 15/26 165/178 |
| 2009/0014153 | A1 * | 1/2009 | Pimentel ..... | F02B 29/0462 165/67 |
| 2011/0162826 | A1 | 7/2011 | Garret et al. | |
| 2012/0210955 | A1 * | 8/2012 | Keerl ..... | F02B 29/0462 123/41.56 |

OTHER PUBLICATIONS

Office Action from the US Patent and Trademark Office for U.S. Appl. No. 14/243,031 dated Jul. 28, 2016 (21 pages).
First Office Action from the State Intellectual Property Office of China for Application No. 201410136412.8 dated Jan. 25, 2017 (14 pages).

* cited by examiner

HEAT EXCHANGER AND PRODUCTION METHOD

CROSS-REFERENCE TO RELATED APPLICATIONS

This application claims priority from German Patent Application No. 10 2013 005 796.5, filed Apr. 4, 2013, which is incorporated by reference herein.

BACKGROUND

The invention relates to a stub connection for a heat exchanger which is arranged in a housing and has a stack comprising plates and fins, the housing consisting of housing parts which can be joined together, and at least one first stub for a first heat-exchanging medium integrated into the housing, and there being at least one second stub for a second heat-exchanging medium which extends to outside the housing.

A stub connection is known from DE 10 2006 005 106 A1. The heat exchanger is an indirect charge air cooler which is arranged in an intake manifold which is made from plastic and forms the housing. The stub or stubs which are integrated directly into the intake manifold are those for the charge air. The other stubs for a liquid coolant are situated on a cover plate which is connected to the stack and is suitable for closing an insertion opening in the intake manifold, through which insertion opening the heat exchanger is inserted into the intake manifold and fastened. The other stubs extend to outside the housing and serve for the connection of a line. Intake manifold embodiments of this type and methods of assembling the heat exchanger in the intake manifold which can be derived therefrom are not suitable for all applications, however.

DE 10 2009 039 569 A1 discloses a gas cooler for an internal combustion engine. The stub connection which is present on the gas cooler is configured in two pieces. One piece is soldered to a header box of the gas cooler, the gas cooler is pushed into the housing, and the second part of the stub connection is connected to the first part through a hole in the housing and is sealed by way of two seals.

SUMMARY

It is the object of the invention to develop a stub connection for a heat exchanger which is arranged in a housing which is made from plastic, having the features which are specified at the outset, in such a way that the heat exchanger is suitable for further applications and can be provided with as little assembly complexity as possible.

Because, according to one embodiment of the invention, at least one second stub which is configured on a first side for the connection of a line for a second heat-exchanging medium is also integrated directly or else indirectly into the housing, the assembly complexity is reduced.

In one embodiment, the direct integration is distinguished by the single-piece configuration of the housing or a housing part with the second stub or stubs, which results in an advantageous reduction in the number of individual parts. Here, for example, part of the second stub can be integrated into a housing part and the missing other part of the second stub can be integrated into another housing part. The complete second stub is produced after the housing parts have been joined together.

In other embodiments the invention provides an indirect integration in which the second stub or stubs, like the housing, is/are composed of a plastic and is/are, for example, welded or adhesively bonded to or in an opening of the housing, without a further seal. In this case, two second stubs which are connected by means of a plate represent one common component which is welded in or to the opening. The number of individual parts can also be reduced as a result of this configuration. The plate then forms either part of the housing wall or represents partial doubling of the housing wall. Even in the case of indirect integration, the housing consists of two or more housing parts which can be assembled to produce the housing.

Other embodiments are directed to a heat exchanger which has a stub connection of above-described type.

Exemplary embodiments of the invention will be described using the appended figures which are merely outline illustrations.

DETAILED DESCRIPTION

The abovementioned outline illustrations relate mainly to the illustration of the housing 1 and the inner construction of the heat exchanger 5. The heat exchanger 5 has a stack 50 comprising fins and plates or tubes, which can be seen from FIG. 5 or 6.

Figure 3:
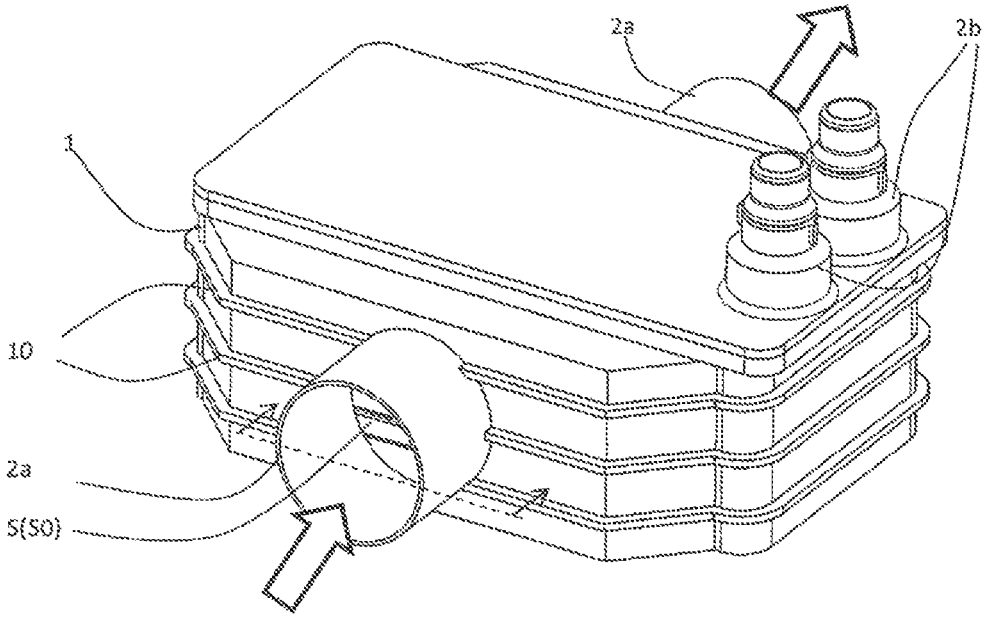
FIGS. 3 and 4 show perspective views of the heat exchanger arrangements.
Figure 4:
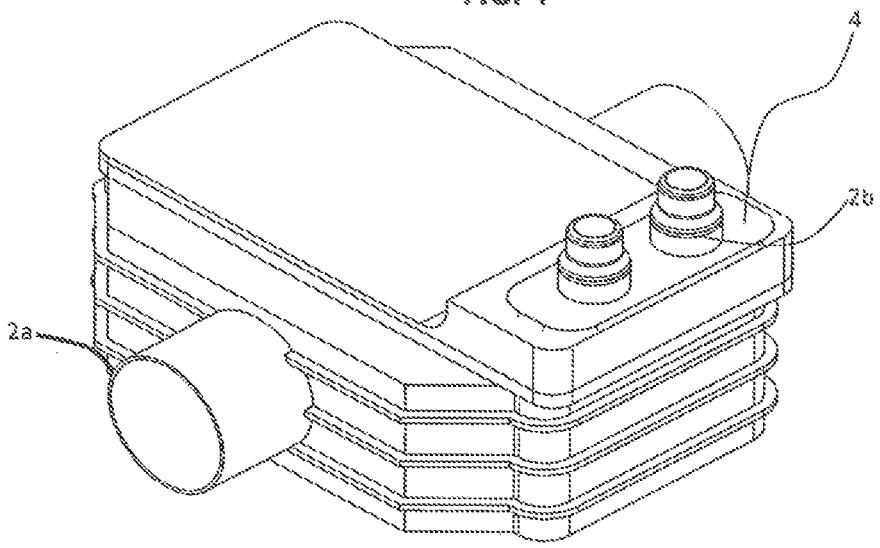

As FIG. 3 or 4 are intended to clarify two first stubs 2*a* are configured in one piece with the housing 1 which is made from plastic, that is to say have been integrated directly or immediately into the housing 1. The housing 1 has been equipped with reinforcing ribs 10 on the outside.

One of the first stubs 2*a* is an inlet stub and the other is an outlet stub for a first heat-exchanging medium.

The housing 1 can be an intake manifold 1 of an internal combustion engine (not shown), the inlet and the outlet stub then serving for the feeding in and the discharge of charge air or a mixture of charge air and exhaust gas. The gas flows through the abovementioned fins of the heat exchanger 5. On the outlet side which is identified in FIG. 3 by way of a block arrow, a plurality of first stubs 2*a* of this type can be configured in one piece with the intake manifold 1. The housing or the intake manifold 1 is configured in multiple pieces for reasons of manufacturing technology. FIG. 3 or 4 can be understood to show a two-piece intake manifold design.

The lower housing part is of trough-like configuration and the upper housing part is of plate-like configuration.

The dashed auxiliary line which passes transversely and horizontally through the inlet stub 2*a* in FIG. 3 and has two arrows is intended to indicate one of a plurality of possible alternative intake manifold divisions. The two housing parts can be welded to one another, for example, after the installation of the heat exchanger 5.

The intake manifold design is advantageous in that the second stubs 2*b* have also been integrated directly or indirectly into the intake manifold 1. The second stubs 2*b* serve to feed in and discharge a second heat-exchanging medium, that is to say for a liquid here, for example, which flows through the abovementioned plates or tubes of the stack 50. They are therefore configured toward the outer side as connecting stubs for corresponding lines (not shown).

Figure 1:
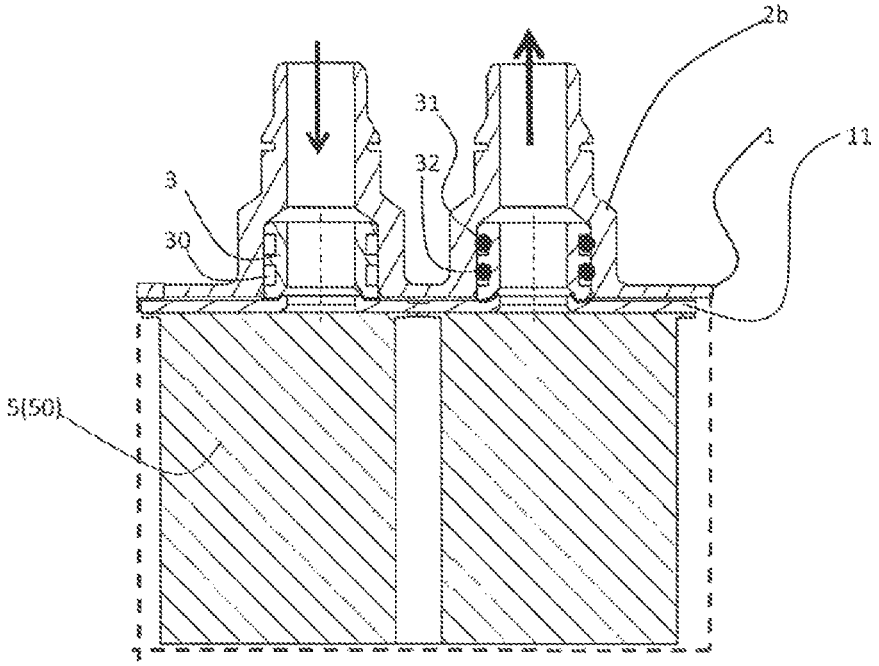
FIG. 1 shows a cross section through a stub connection and the associated heat exchanger in the housing, with direct integration of the second stubs.
Figure 5:
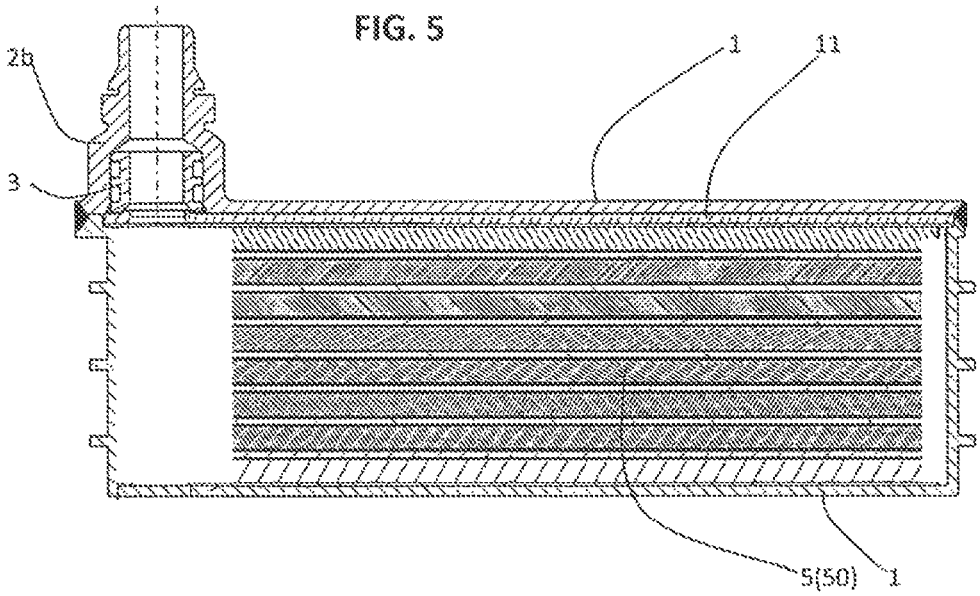
FIGS. 5 and 6 show longitudinal sections through FIGS. 3 and 4, respectively.

As FIG. 1 and the associated FIGS. 3 and 5 show best, the second stubs 2*b* are configured on their opposite other side as receiving stubs for a plug-in stub 3. The plug-in stub 3 has been arranged on the stack 50, more precisely on a cover plate 11 of the stack 50. It corresponds with the plates or tubes of the heat exchanger 5.

The plug-in stub 3 has two grooves 30 which are arranged at a spacing and in each case contain a seal 31, which seals toward the receiving stub 2*b*. In FIG. 1, the upper seal 31 seals toward the liquid side and the lower seal 32 seals toward the charge air side which can flow between the intake manifold 1 and the cover plate 11 as far as up to the plug-in stub 3.

Figure 2:
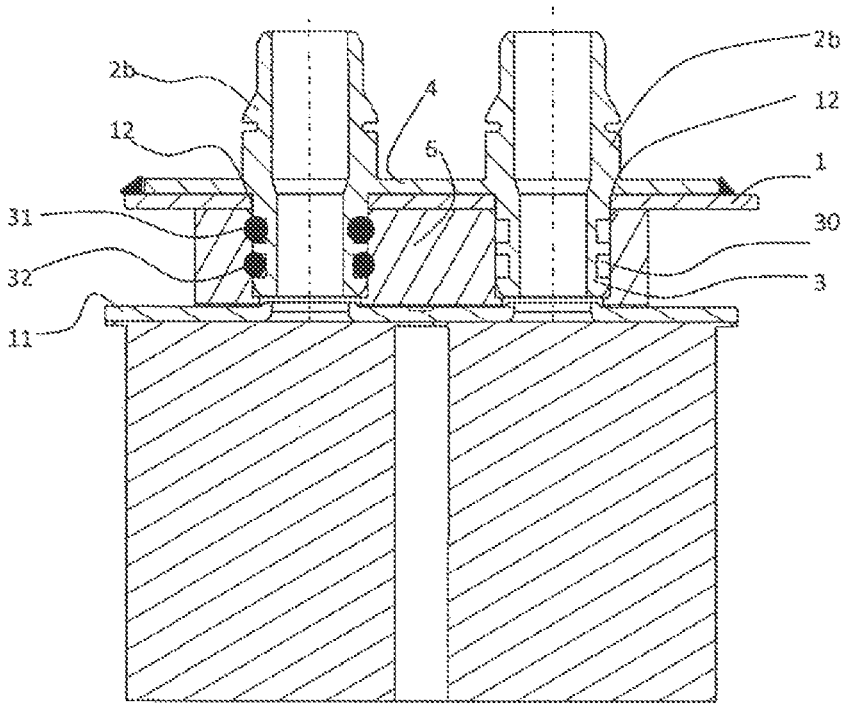
FIG. 2 shows indirect integration of the second stubs.

In contrast to this, in FIG. 2, the lower seal 32 seals toward the liquid side and the upper seal seals toward the charge air side. The seals 31, 32 are situated on all plug-in stubs 3 and all second stubs 2*b*, although they are shown merely on one of the stubs 2*b*, 3.

Figure 6:
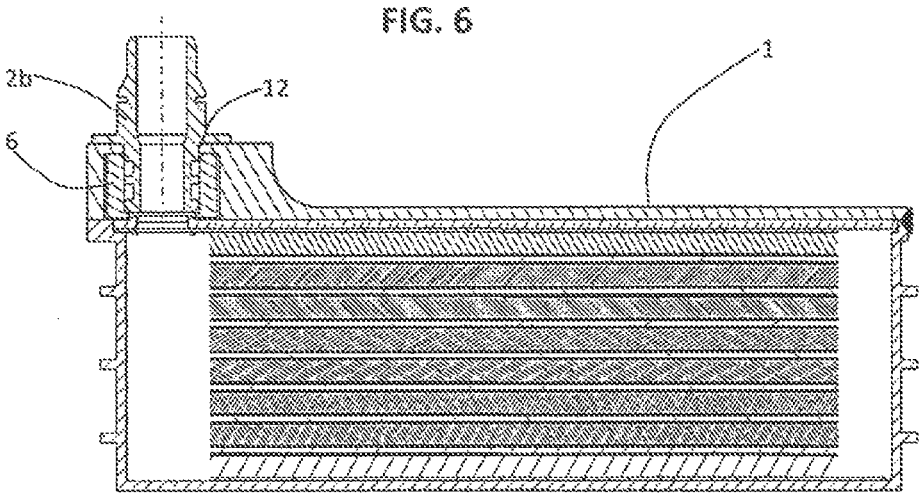

Alternatively, FIG. 2 and the associated FIGS. 4 and 6 show the indirect integration of the second stub or stubs 2*b* into the intake manifold 1. The second stubs 2*b* are composed of the same plastic as the intake manifold 1. Two second stubs 2*b* have been combined to produce a prefabricated component 4. Furthermore, in contrast to the exemplary embodiment which was described at the outset, this exemplary embodiment has a connection block 6 which is soldered on the cover plate 11. The connection block 6 has through openings which likewise correspond with the plates or tubes in the heat exchanger 5. The second stubs 2*b* of this exemplary embodiment are situated in the through openings, which second stubs 2*b* are configured toward the inside as plug-in stubs 3 and have the abovementioned grooves 30 and seals 31, 32.

There are openings 12 in the intake manifold 1, through which openings 12 the second stubs 2*b* or their plug-in stubs 3 extend, in order to pass into the through openings of the connection block 6. The prefabricated component 4 is welded to the intake manifold 1, or at any rate is attached in a sealed and fixed manner. As can be seen in FIG. 2, there is a double wall in the arrangement region of the component 4, which double wall consists of part of the intake manifold wall and of a wall of the component 4.

What is claimed is:

1. A heat exchanger comprising:

a stack of plates and fins in a housing;

at least one first stub for a first heat-exchanging medium integrated directly into the housing;

a stub connection for the heat exchanger, the stub connection including:

at least one second stub for a second heat-exchanging medium including a first stub end and a second stub end, the at least one second stub being integrated directly or indirectly into a planar wall of the housing, and connected to the heat exchanger by the second stub end at a location within the housing, wherein the first stub end is arranged external to the housing and is separated from the second stub end by the planar wall of the housing, wherein the second stub end includes a first groove which holds a first seal and a second groove which holds a second seal, and wherein the first stub end includes a first stub end opening and the second stub end includes a second stub end opening.

2. The heat exchanger according to claim 1, wherein the first and second seals each seal toward the heat exchanger.

3. The heat exchanger according to claim 2, wherein the first seal is located between the distal end of the second stub end and the second seal.

4. The heat exchanger according to claim 1, wherein the at least one second stub includes two second stubs that are integrated directly or indirectly into the planar wall of the housing, one of the second stubs representing an inlet stub and the other of the second stubs representing an outlet stub for the second heat-exchanging medium.

5. The heat exchanger according to claim 4, wherein the two second stubs are configured from the same plastic as the housing and the two second stubs together with the planar wall are a prefabricated component.

6. The heat exchanger according to claim 5, wherein the planar wall of the component is welded or adhesively bonded to the housing.

7. The heat exchanger according to claim 1, further comprising a cover plate arranged on the stack and a connection block joined to the cover plate, the connection block having two through openings for the second heat-exchanging medium.

8. The heat exchanger according to claim 7, wherein the second stub end of the at least one second stub is seated in one of the through openings such that the first and the second seals both provide a seal between the at least one second stub and the connection block.

9. The heat exchanger according to claim 2, wherein the first seal and the second seal are arranged sequentially to isolate the first and second heat exchanging media so that the second seal prevents the first heat exchanging medium from contacting the first seal and so that the first seal prevents the second heat exchanging medium from contacting the second seal.

10. The heat exchanger according to claim 8, wherein the first seal and the second seal are arranged sequentially to isolate the first and second heat exchanging media so that the second seal prevents the first heat exchanging medium from contacting the first seal and so that the first seal prevents the second heat exchanging medium from contacting the second seal.

11. The heat exchanger according to claim 7, wherein the at least one second stub includes two second stubs that are integrated directly or indirectly into the planar wall of the housing, one of the second stubs representing an inlet stub and the other of the second stubs representing an outlet stub for the second heat-exchanging medium, the second stub end of the inlet stub being seated in a first one of the through openings and the second stub end of the outlet stub being seated is a second one of the through openings.

12. The heat exchanger according to claim 11, wherein the second stub ends of each of the inlet and outlet stubs include two grooves which each include a seal, which seals to the connection block.

13. The heat exchanger according to claim 11, wherein the two second stubs and the planar wall together define a prefabricated component.

14. The heat exchanger according to claim 13, wherein the prefabricated component is joined to the housing by way of the planar wall.

15. The heat exchanger according to claim 14, wherein the prefabricated component is joined to the housing by welding or adhesively bonding.

* * * * *